United States Patent [19]

Takeda et al.

[11] Patent Number: 4,518,637

[45] Date of Patent: May 21, 1985

[54] COATING SOLUTION METERING METHOD AND APPARATUS

[75] Inventors: Hideo Takeda; Tsunehiko Sato, both of Kanagawa, Japan

[73] Assignee: Fuji Photo Film Co., Ltd., Kanagawa, Japan

[21] Appl. No.: 495,928

[22] Filed: May 19, 1983

[30] Foreign Application Priority Data

May 19, 1982 [JP] Japan ..... 57-83237

[51] Int. Cl.[3] ..... B05D 3/00

[52] U.S. Cl. ..... 427/359; 118/118; 118/119; 118/206; 118/259; 118/414; 427/361; 427/371; 427/428

[58] Field of Search ..... 427/359, 371, 428, 331, 427/361; 118/206, 414, 118, 119, 259

[56] References Cited

U.S. PATENT DOCUMENTS

| | | | |
|---|---|---|---|
| 3,461,837 | 8/1969 | Dreher | 118/119 |
| 3,496,012 | 2/1970 | Biorseth | 118/414 |
| 3,817,208 | 6/1974 | Barnscheidt et al. | 118/119 |
| 4,245,582 | 1/1981 | Alheid et al. | 118/119 |

*Primary Examiner*—Norman Morgenstern
*Assistant Examiner*—Janyce A. Bell
*Attorney, Agent, or Firm*—Sughrue, Mion, Zinn, Macpeak & Seas

[57] ABSTRACT

In method of metering a coating solution, a coil bar is rotatably supported on a holder, and after a coating solution is applied to a web which is continuously run, a surplus of coating solution is scraped off with the coil bar, metering is carried out while a solution which is substantially the same in composition as said coating solution is supplied continuously to both sides of the coil bar which are before and after in the direction of run of the web, at a predetermined flow rate.

5 Claims, 4 Drawing Figures

COATING SOLUTION METERING METHOD AND APPARATUS

BACKGROUND OF THE INVENTION

1. Field of the Invention

This invention relates to a method of metering a coating solution in which, after a coating solution is applied to a continuously running web, surplus coating solution on the web is scraped off with a coil bar to form a coated film or layer to a desired thickness, and to an apparatus for practicing the method.

2. Description of the Prior Art

The term "web" as herein use is not limited and is intended to mean a relatively long, flexible, belt-shaped support such as: a plastic film of cellulose triacetate, polyamide, polyimide, polycarbonate, polyethylene terephthalate or polyvinyl chloride; paper; synthetic paper; a metal foil of aluminum or copper; sheet of glass or ceramic and the like.

The term "coating solution" as used herein is not limited and is intended to mean a variety of coating solutions different in composition depending on the purpose of use. Examples of the "coating solutions" are coating solution for forming a photosensitive emulsion layer, a base layer, a protective layer and a back layer as are used in a conventional photographic photosensitive material; coating solutions for forming a magnetic layer, a base layer, a wetting layer, a protective layer and a back layer as used in a conventional magnetic recording medium; and coating solutions for forming an adhesive layer, a coloring layer, a rust-proofings layer, etc. These coating solutions are made up of essential components, a binder, and, if necessary, water or organic solvent or dispersion containing various additives.

In order to form a coated film on the above-described web to a desired thickness, the following methods are now extensively employed: Conventional coating means such as a dip, reverse roll, gravure roll, extrusion hopper or slide hopper are used to apply an excess of coating solution to the web which is run continuously. Then, metering means such as an air knife, blade or coil bar (or wire bar) are contacted with the coated layer to scrape off surplus coating solution to thereby coat the web with the coating solution to the degree or thickness.

In coating a web with a coating solution of high viscosity, such as a magnetic solution for forming a magnetic recording medium, a coil bar has been extensively employed as the metering means because it is simple in structure and can be readily handled as compared with the air knife or blade, and the coated surface is relatively stable in quality.

A conventional coating method using the coil bar is as shown in FIG. 1.

As shown in FIG. 1, a web 1 is run continuously in the direction of the arrow, and a coating solution 3 is applied to the lower surface of the web 1 to a thickness larger than finally required to form a coated film 5 in the liquid state. Surplus coating solution 7 is scraped off by the coil bar 6 so that a coated film 8 is formed whose thickness is regulated by the gap defined by the cylindrical wall of the coil bar 6 and the surface of the web 1. If desired or necessary, for instance in the case of forming a magnetic layer, the product is subjected to magnetic field orientation and dried and is then wound.

In FIG. 1, reference numeral 4 designates guide rolls rotating in the direction of the arrow.

The coil bar 6, as shown in FIG. 2, is made up of a core material or a rod member 9 and a wire 10 which is wound in the form of a single coil on the cylindrical wall of the rod member 9 with the turns being in close contact with one another. In general, rod member 9 is a stainless steel, iron or brass rod 1 to 3 mm in diameter, and wire 10 is a stainless steel, trifluoroethylene homopolymer, tetrafluoroethylene homopolymer, or tetrafluoroethylene-hexafluoropropylene copolymer wire 0.04 to 0.05 mm in diameter. In addition to the above-described coil bar, a small coil bar less than 4 mm in maximum coil radius which was proposed by the present inventors may be employed (see Japanese patent application No. 41060/1981).

In general, the web is dried after being subjected to metering as described above, and is then wound. For instance in the case of manufacturing a magnetic recording medium, the web is subjected to special processes such as a magnetic field orientation process and a surface smoothing process.

In order that a coated film of excellent surface quality is obtained by effectively carrying out the metering operation with a coil bar, the coil bar should be wet with the coating solution during the metering operation. Usually the coil bar is wetted by the coating solution during the metering operation. However, when a coating solution of high viscosity is used or coating speed is increased, the coil bar is not sufficiently wet by the coating solution. Accordingly, in this case, rib-shaped stripes are formed on the coated surface after the metering operation, or the coated surface is not smooth. Furthermore, the coating solution on the coil bar hardens and sticks to the coated surface which has been metered, thus degrading the coated surface.

In order to eliminate the above-described difficulties, a method as shown in FIG. 3 has been proposed. In this method, a coil bar 12 as described above is rotatably supported by a holder 13. The holder 13 has a solution supplying slot 14 which opens below the coil bar 12. A solution, which is substantially the same in composition as the coating solution, is supplied through the slot 14 to the coil bar 12 to wet the same during metering. In FIG. 3, reference numeral 1 designates a web which is run continuously in the direction of the arrow. The solution which has wet the coil bar drops down the rear wall of the holder (as indicated at 16) or drops down the front wall of the holder together with coating solution which has been subjected to metering (as indicated at 15) to be recovered or recycled.

It is true that this method is somewhat effective, but, it still suffers from the problem that the solutions flow down the front and rear walls of the holder irregularly, i.e., the solutions do not flow down the walls uniformly, so that the solutions may dry. Thus, even this coil bar wetting method still suffers from problems.

SUMMARY OF THE INVENTION

The inventors conducted intensive research on a metering method for wetting the coil bar more effectively to make the coated layer excellent in smoothness. As a result of such research, the inventors found that by supplying a solution which is substantially the same in composition as the coating solution to both sides of the coil bar, i.e., the sides which are before (upstream) and after (downstream) with respect to the direction of running of the web at a predetermined flow rate, the coil bar will be completely wetted and metering can be carried out satisfactorily.

DESCRIPTION OF PREFERRED EMBODIMENTS

Provided according to the invention are a method of metering a coating solution in which a coil bar is rotatably supported on a holder, and, after a coating solution is applied to a web which is continuously run, surplus coating solution is scraped off with the coil bar wherein, according to the invention, metering is carried out while a solution which is substantially the same in composition as the coating solution is continuously supplied to both sides of the coil bar which are located upstream and downstream in the direction of running of the web, at a predetermined flow rate, and apparatus for metering a coating solution coated on a continuously running web, which comprises a coil bar and a holder rotatably supporting the coil bar wherein, according to the invention, the holder has two solution-supplying slots the upper ends of which open at both sides of the coil bar and which are located upstream and downstream in the direction of running of the web, so that a solution which is substantially the same in composition as the coating solution is supplied at a predetermined flow rate during metering.

This invention will be described with reference to the accompanying FIG. 4.

Figure 1:
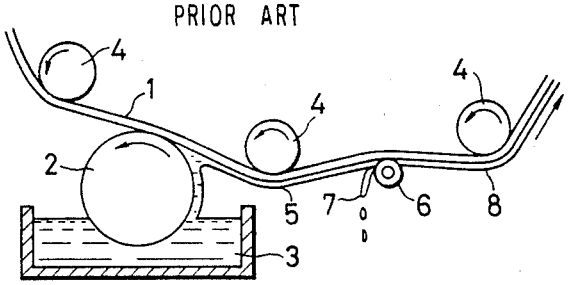
FIG. 1 PRIOR ART
FIG. 1 is an explanatory diagram showing one example of a conventional coating method.
Figure 2:
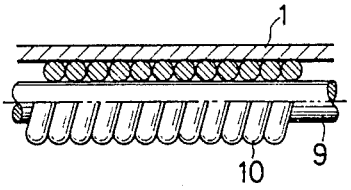
FIG. 2 is a sectional view showing a part of the coil bar which is employed in this invention.
Figure 3:
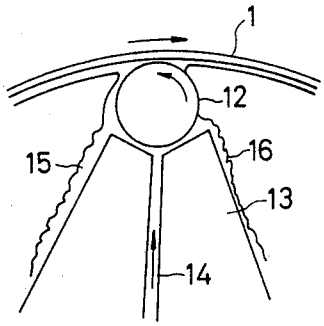
FIG. 3 PRIOR ART
FIG. 3 is a sectional view showing a conventional metering method.
Figure 4:
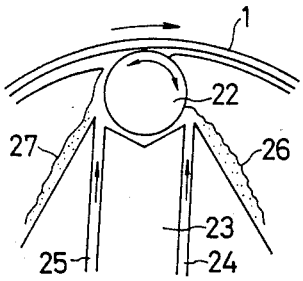
FIG. 4 is a sectional view showing one example of a metering method according to the invention.

FIG. 4 is a sectional view showing one embodiment of the invention. A coil bar 22 similar to the above-described one is rotatably supported by holder 23, which has two slots 24 and 25. It is desirable that the slots 24 and 25 extend vertically as shown in FIG. 4; however, they may be somewhat inclined if desired. The two slots open before and after the coil bar (as viewed in the direction of running of the web), that is, the positions of the openings of the slots correspond to the two ends of the maximum diameter (as viewed in the direction of running of the web) of the coil bar in FIG. 4.

Metering is carried out while a solution which is substantially the same as the coating solution is supplied through the two slots to both sides of the coil bar 22.

Phrased differently, the above-described coating solution is applied to the web, which is continuously run in the direction of the arrow, via a suitable coating means such as a reverse roll and surplus coating solution is scraped off by the coil bar 22 so that a coated film is formed on the web at the desired thickness. In this connection, according to the invention, the solution is continuously supplied to both sides of the coil bar, and therefore, the coil bar is efficiently wetted. Accordingly, even when a coating solution of high viscosity is applied to the web at high speed, the above-described difficulty with conventional methods is not encountered.

The solution supplied through the slot 24 mainly flows down the downstream wall (as viewed in the direction of running of the web) of the holder, while the solution supplied through the slot 25 mainly flows down the downstream wall of the holder together with the coating solution which has been subjected to metering. Thus, the solutions can be recovered or recycled.

The solution supplied through slots 24 and 25 wets the coil bar as described above, the coil bar contacts the coating solution, and the solution together with surplus coating solution is recovered or recirculated to the coating means and/or the slots. Therefore, it is desirable that the solution supplied to the coil bar through the slots be the same in composition as the coating solution; however, it is not always necessary that the former be completely identical in composition to the latter. For example, the wetting solution need only be the same in composition as the coating solution to the extent that it does not degrade the quality of the product when recirculated.

The speed at which the solution is supplied through the slots depends on the kind of solution employed, the width of the slots and the coating speed and should be so selected that the coil bar is maintained wet at all times according to these conditions.

For instance in the case of manufacturing a magnetic recording medium, a magnetic solution having the following composition was applied to a polymer film 1000 cm in width at a coating speed of 100 m/min, and metering was carried out with a coil bar 3 mm in maximum diameter. In this case, a magnetic solution having the same composition was supplied through slots 0.5 mm in width at a flow rate of 1 l/min. As a result, the coating solution was metered satisfactorily, and the coated layer was excellent in smoothness.

In the above-described embodiment, the coil bar 22 is rotated in the direction opposite to the web travelling direction. However, the rotational direction of the coil bar may be determined according to the speed of web and the physical characteristics of coating solution, such as viscosity.

While the invention has been described in detail and with reference to specific embodiment thereof, it will be apparent to one skilled in the art that various changes and modifications can be made therein without departing from the spirit and scope thereof.

What is claimed is:

1. A method of metering a coating solution wherein a coil bar is rotatably supported on a holder comprising the steps of: continuously supplying a solution substantially the same as said coating solution to both sides of the coil bar at parallel positions upstream and downstream in the direction of running of the web, at a predetermined flow rate, applying said solution to said coil bar to wet said coil bar and, removing surplus solution by scraping said web with said coil bar.

2. An apparatus for metering a coating solution coated on a continuously running web comprising, a coil bar and a holder for rotatably supporting said coil bar, said holder having two solution-supplying slots with upper ends opening in parallel at both sides of the coil bar at positions upstream and downstream in the direction of running of the web, wherein slots are adapted to apply a solution which is substantially the same in composition as the coating solution is supplied from said source at a predetermined flow rate during metering.

3. The apparatus of claim 2 wherein said slots having openings spaced corresponding to the diameter of said coil bar.

4. The apparatus of claim 2 wherein said holder defines walls for each of said solution-supplying slots.

5. The apparatus of claim 2 further comprising slide surface adapted to remove excess solution disposed upstream and downstream of said solution-supplying slots in the direction of said running web.

* * * * *